US011882942B2

(12) United States Patent
Kang

(10) Patent No.: US 11,882,942 B2
(45) Date of Patent: Jan. 30, 2024

(54) SEAT AND ASSEMBLY FOR A SEAT

(71) Applicant: HILLSOUND EQUIPMENT INC., Vancouver (CA)

(72) Inventor: Chang Sun Kang, Coquitlam (CA)

(73) Assignee: HILLSOUND EQUIPMENT, INC., Vancouver (CA)

( * ) Notice: Subject to any disclaimer, the term of this patent is extended or adjusted under 35 U.S.C. 154(b) by 87 days.

(21) Appl. No.: 17/600,059

(22) PCT Filed: Apr. 15, 2020

(86) PCT No.: PCT/CA2020/050501
§ 371 (c)(1),
(2) Date: Sep. 29, 2021

(87) PCT Pub. No.: WO2020/210903
PCT Pub. Date: Oct. 22, 2020

(65) Prior Publication Data

US 2022/0183471 A1 Jun. 16, 2022

Related U.S. Application Data

(60) Provisional application No. 62/834,556, filed on Apr. 16, 2019.

(51) Int. Cl.
*A47C 9/10* (2006.01)
*A47C 4/28* (2006.01)

(52) U.S. Cl.
CPC ..... *A47C 9/105* (2013.01); *A47C 4/286* (2013.01)

(58) Field of Classification Search
CPC ..... A47C 4/286; A47C 9/105
See application file for complete search history.

(56) References Cited

U.S. PATENT DOCUMENTS 115,598 A 6/1871 Free
1,115,598 A 6/1871 Free
(Continued)

FOREIGN PATENT DOCUMENTS

CA 2306180 C 4/1999
CN 2084325 U 9/1991
(Continued)

OTHER PUBLICATIONS http://www.walkstool.com/.
https://www.rei.com/c/camp-chairs (retrieval date of Dec. 6, 2018).

*Primary Examiner* — Anthony D Barfield
(74) *Attorney, Agent, or Firm* — D'Ambrosio & Menon, PLLC; Usha Menon

(57) ABSTRACT

An assembly for a seat includes a pivot hub defining multiple rotation axes, and a displacing module attached to the pivot hub. Extendable legs are rotatably coupled to the pivot hub and comprise locking devices movable between an unlocked position, in which the legs, when extended, are enabled to retract, and a locked position, in which the legs, when extended, are prevented from retracting. The legs are rotatable between an intermediate position and a deployed position. When the legs are extended, and when in the intermediate position, the displacing module engages the locking devices to move the locking devices from the locked position to the unlocked position. When the legs are extended, rotating the legs from the intermediate position to the deployed position brings the displacing module out of contact with the locking devices.

19 Claims, 15 Drawing Sheets

(56) References Cited

U.S. PATENT DOCUMENTS

| | | | |
|---|---|---|---|
| 4,934,638 | A | 6/1990 | Davis |
| 5,851,052 | A | 12/1998 | Gustafsson |
| 5,876,091 | A | 3/1999 | Chernomashentsev |
| 6,135,557 | A | 12/2000 | Gustafsson |
| 6,471,287 | B1 | 10/2002 | Liu |
| 6,644,731 | B2 | 11/2003 | Tang |
| 6,871,905 | B2 | 3/2005 | Grace |
| 6,926,356 | B2 | 8/2005 | Chen |
| 7,367,617 | B1 | 5/2008 | Bond |
| 7,384,097 | B2 | 6/2008 | Park |
| 7,401,850 | B2 | 7/2008 | Micheel |
| 7,413,254 | B2 | 8/2008 | Petre, Jr. |
| 7,748,777 | B2 | 7/2010 | Forrest et al. |
| 8,066,323 | B2 | 11/2011 | McCabe |
| 8,141,944 | B2 | 3/2012 | Reeb et al. |
| 8,317,140 | B1 | 11/2012 | Chung |
| 9,144,312 | B2 | 9/2015 | Grace |
| 9,357,820 | B2 | 6/2016 | Pao |
| 10,064,462 | B2 | 9/2018 | Pao |
| 2007/0216212 | A1 | 9/2007 | Micheel |
| 2013/0187431 | A1 | 7/2013 | Grace |
| 2017/0099955 | A1 | 4/2017 | Aydt |
| 2018/0035815 | A1 | 2/2018 | Pelleossa |

FOREIGN PATENT DOCUMENTS

| | | | |
|---|---|---|---|
| CN | 1276706 | A | 12/2000 |
| CN | 204032811 | U | 12/2014 |
| CN | 104323618 | A | 2/2015 |
| CN | 104771291 | A | 7/2015 |
| CN | 205658648 | U | 10/2016 |
| CN | 107405001 | A | 11/2017 |
| CN | 109463923 | A | 3/2019 |
| DE | 102014205468 | A1 | 9/2015 |
| ER | 557808 | A | 8/1923 |
| WO | 2017217712 | A1 | 12/2017 |

SEAT AND ASSEMBLY FOR A SEAT

FIELD OF THE DISCLOSURE

The present disclosure relates to a seat and to an assembly for a seat.

BACKGROUND TO THE DISCLOSURE

Camping stools are portable seats that are used for camping and similar outdoor activities. Because of the general desire during such activities to minimize the space taken up by such seats, it is preferable for camping stools to include one or more extendable legs. When not in use, the legs of the stool may be retracted or collapsed, reducing the size of the stool.

However, such stools generally rely on inefficient locking mechanisms for securing the legs in the extended position. For example, a user may need to manually engage a push-button to unlock the legs, or else may need to use locking clamps. It would be advantageous if a stool or similar seat were provided with a simpler and more efficient means of enabling locking and unlocking of the extendable legs.

In this context, the present disclosure seeks to provide an improved seat and an improved assembly for a seat.

SUMMARY OF THE DISCLOSURE

According to a first aspect of the disclosure, there is provided an assembly for a seat, comprising: a pivot hub defining multiple rotation axes; a displacing module for attaching to the pivot hub; legs for rotatably coupling to the pivot hub, wherein at least one of the legs is extendable, the legs comprising one or more locking devices movable between an unlocked position, in which the at least one extendable leg, when extended, is enabled to retract, and a locked position, in which the at least one extendable leg, when extended, is prevented from retracting, wherein the legs, when rotatably coupled to the pivot hub, are rotatable about the rotation axes between an intermediate position and a deployed position, wherein, when the least one extendable leg is extended and when the displacing module is attached to the pivot hub: in the intermediate position, the displacing module engages the one or more locking devices to move the one or more locking devices from the locked position to the unlocked position; and rotating the legs from the intermediate position to the deployed position brings the displacing module out of contact with the one or more locking devices.

The pivot hub may comprise first alignment features. The legs may further comprise second alignment features for aligning with the first alignment features. When the first alignment features are aligned with the second alignment features, the legs may be translatable relative to the pivot hub and along the rotation axes such that the legs may be coupled with the pivot hub. When the legs are coupled with the pivot hub, and when the first alignment features are not aligned with the second alignment features, the legs may be prevented from being decoupled from the pivot hub by engagement of the first alignment features with the second alignment features.

The first alignment features may comprise one of male and female alignment features, and the second alignment features may comprise the other of male and female alignment features.

The pivot hub may further comprise arms extending from a central portion of the pivot hub, and the arms may define respective ones of the rotation axes. The arms may comprise the first alignment features at ends of the arms. The first alignment features may comprise teeth extending from the ends of the arms.

The at least one extendable leg may comprise: at least one inner leg portion arranged to translate relative to at least one outer leg portion; and a leg holder comprising one or more of the second alignment features and fixed to the at least one inner leg portion or the at least one outer leg portion.

The leg holder may be fixed to the at least one outer leg portion.

The leg holder may comprises a first aperture formed therein. The at least one inner leg portion and/or the at least one outer leg portion may comprise a second aperture formed therein. The first and second apertures may be positioned such that translating the at least one inner leg portion relative to the at least one outer leg portion causes the first and second apertures to be brought into alignment.

The at least one extendable leg may comprise one or more portions thereof for preventing rotation of the at least one inner leg portion or the at least one outer leg portion relative to the leg holder. The one or more portions may comprise one or more flattened portions of the leg holder and one or more flattened portions of the at least one inner leg portion.

The one or more locking devices may comprise one or more resilient biasing members. The one or more resilient biasing members may comprise one or more springs with one or more spring feet. The one or more springs may be arranged to bias the one or more spring feet such that, in the locked position and when the at least one extendable leg is in the deployed position, the one or more spring feet extend through one or more leg apertures formed in the at least one extendable leg. The one or more springs may be further arranged to bias the one or more spring feet such that, in the locked position and when the at least one extendable leg is in the deployed position, the one or more spring feet further extend through one or more leg holder apertures formed in a leg holder fixed to the at least one extendable leg.

The one or more leg apertures may be formed in at least one inner leg portion of the at least one extendable leg. The at least one inner leg portion may be arranged to translate relative to at least one outer leg portion of the at least one extendable leg.

When the at least one extendable leg is extended and is in the intermediate position, and when the displacing module is attached to the pivot hub, the displacing module may be shaped to engage the one or more spring feet and prevent the one or more spring feet from extending through the one or more leg apertures, thereby enabling retraction of the at least one extendable leg.

The one or more spring feet may further comprise one or more tapered portions. When the at least one extendable leg is extended and is in the intermediate position, and when the displacing module is attached to the pivot hub, the displacing module may be shaped to engage the one or more spring feet and prevent the one or more spring feet from extending out of the one or more leg holder apertures. The one or more tapered portions may facilitate retraction of the at least one extendable leg.

The assembly may further comprise a seat cover for attaching to upper ends of the legs. The seat cover may comprise cover apertures for aligning with apertures formed in the upper ends of the legs. The assembly may further comprise fasteners for inserting into the cover apertures and the apertures of the upper ends of the legs to attach the seat cover to the upper ends of the legs. The fasteners may be removable.

The legs may comprise feet at lower ends thereof. The feet may comprise first feet members and second feet members that are longer than the first feet members. The legs may meet the feet where the first portions meet the second portions.

The first and second alignment features may be shaped such that the first alignment features align with the second alignment features once every full rotation of the legs relative to the pivot hub.

The first alignment features and the second alignment features may not align with one another during rotation of the legs relative to the pivot hub from the intermediate position to the deployed position. In the deployed position, the legs may have been rotated to an extent required for apertures in a seat cover to be aligned with apertures formed within upper ends of the legs.

The legs may comprise at least three legs.

The leg holders may be sized such that, when rotating the legs in a direction of rotation from the deployed position to the intermediate position, at the intermediate position the leg holders engage with one another and prevent further rotation of the legs in the direction of rotation.

According to a further aspect of the disclosure, there is provided an assembly for a seat, comprising: a pivot hub defining multiple rotation axes; a displacing module attached to the pivot hub; legs rotatably coupled to the pivot hub, wherein at least one of the legs is extendable, the legs comprising one or more locking devices movable between an unlocked position, in which the at least one extendable leg, when extended, is enabled to retract, and a locked position, in which the at least one extendable leg, when extended, is prevented from retracting, wherein the legs are rotatable about the rotation axes between an intermediate position and a deployed position, wherein, when the least one extendable leg is extended: in the intermediate position, the displacing module engages the one or more locking devices to move the one or more locking devices from the locked position to the unlocked position; and rotating the legs from the intermediate position to the deployed position brings the displacing module out of contact with the one or more locking devices.

According to a further aspect of the disclosure, there is provided an assembly for rotatably coupling to legs of a seat, the assembly comprising: a pivot hub comprising arms extending from a central portion of the pivot hub, wherein the arms comprise teeth extending from ends of the arms; and a displacing module for attaching to the central portion.

According to a further aspect of the disclosure, there is provided an extendable leg for a seat, comprising: at least one inner tube arranged to translate relative to at least one outer tube, wherein the at least one inner tube comprises an aperture formed therein; and a spring located at least partially within the at least one inner tube and having a spring foot, wherein the spring is arranged to bias the spring foot in a direction of the aperture such that, when the at least one inner tube is translated at least partially out of the at least one outer tube such that the at least one outer tube does not overlap the aperture, the spring foot extends out of the aperture and thereby prevents the at least one inner tube from being translated back into the at least one outer tube.

BRIEF DESCRIPTION OF THE DRAWINGS

Embodiments of the disclosure will now be described in detail in conjunction with the accompanying drawings of which:

FIGS. 17A-170 show different orientations of teeth of the pivot hub of FIGS. 4A and 4B relative to a grooved aperture of the leg holder of FIG. 7, according to embodiments of the disclosure;

DETAILED DESCRIPTION OF EMBODIMENTS

Figure 1:
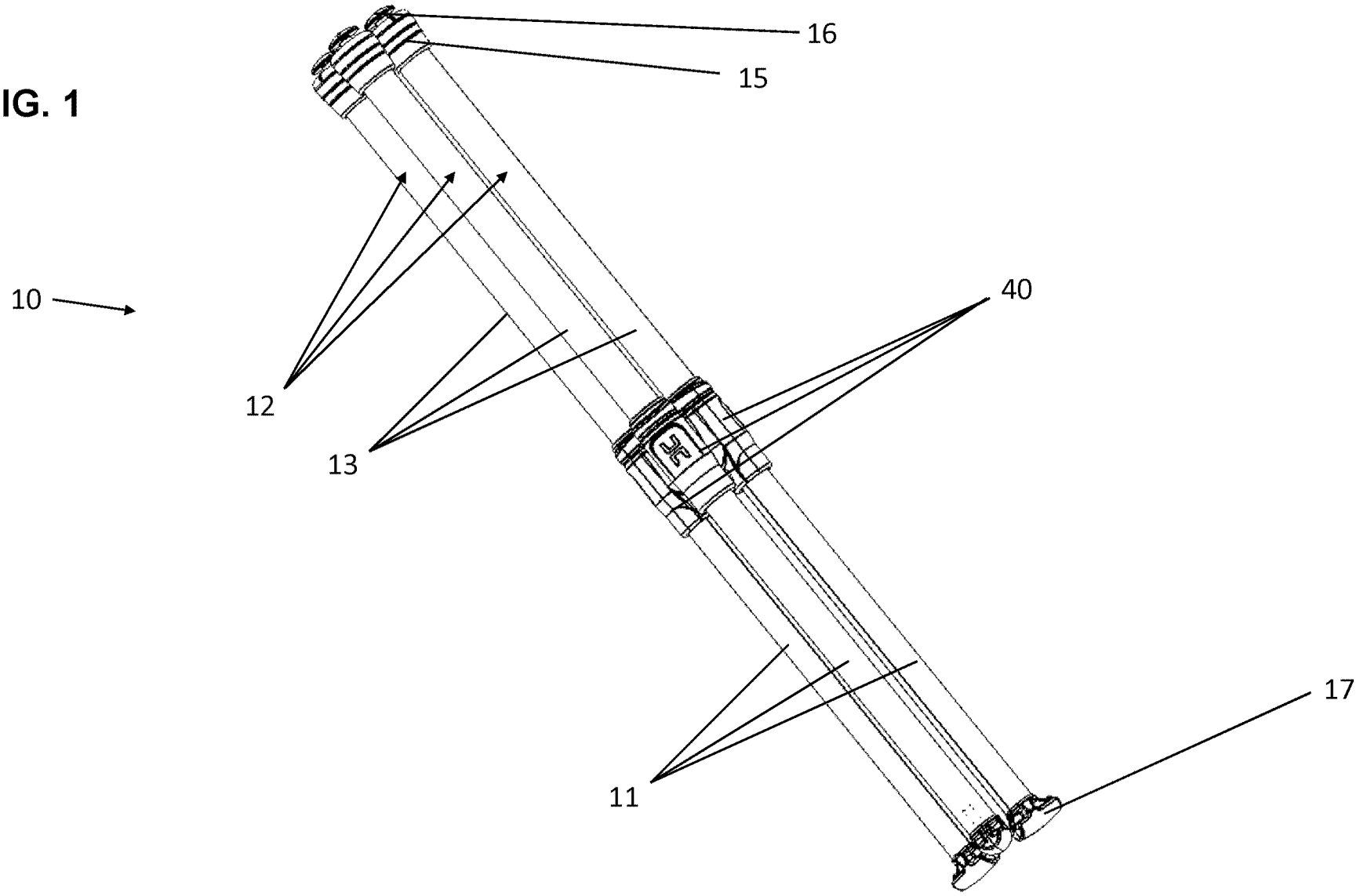
FIG. 1 shows a base structure for a seat, in an intermediate position with legs extended, according to embodiments of the disclosure.

The present disclosure seeks to provide an improved seat and an improved assembly for a seat. While various embodiments of the disclosure are described below, the disclosure is not limited to these embodiments, and variations of these embodiments may well fall within the scope of the disclosure which is to be limited only by the appended claims.

The word "a" or "an" when used in conjunction with the term "comprising" or "including" in the claims and/or the specification may mean "one", but it is also consistent with the meaning of "one or more", "at least one", and "one or more than one" unless the content clearly dictates otherwise. Similarly, the word "another" may mean at least a second or more unless the content clearly dictates otherwise.

The terms "coupled", "coupling" or "connected" as used herein can have several different meanings depending on the context in which these terms are used. For example, the terms coupled, coupling, or connected can have a mechanical or electrical connotation. For example, as used herein, the terms coupled, coupling, or connected can indicate that two elements or devices are directly connected to one another or connected to one another through one or more intermediate elements or devices via an electrical element, electrical signal or a mechanical element depending on the particular context. The term "and/or" herein when used in association with a list of items means any one or more of the items comprising that list.

As used herein, a reference to "about" or "approximately" a number or to being "substantially" equal to a number means being within +/−10% of that number.

Generally, according to embodiments of the disclosure, there is described a seat, such as a stool. The seat includes a supporting base structure comprising a pivot hub that is rotatably coupled to a number of extendable legs about respective axes of rotation. Each leg includes a locking device comprising a spring positioned within the leg and configured to lock the leg in an extended position. In particular, when an inner portion of the leg (or inner leg portion) is translated out of an outer portion of the leg (or outer leg portion), a spring foot is urged to extend out of an aperture formed within the inner leg portion. In such a position, the spring foot blocks or prevents the inner leg portion from being translated back into the outer leg portion, thereby locking the leg in its extended position.

The legs may be rotated to a deployed position, in which the legs are out of alignment with each other. A seat cover may be attached to upper ends of the legs and may be used for sitting on by a user. From the deployed position, the extended legs may be rotated to an intermediate position, in which the extended legs are parallel or aligned with one another. By rotating the legs from the deployed position to the intermediate position, the spring feet that protrude from the holes formed in the inner leg portions are brought into contact with a displacing module that is connected to the pivot hub. The displacing module causes the spring feet to be urged back into the inner leg portions, thereby unlocking the legs from their extended positions. The inner leg portions may then be inserted back into the outer leg portions, retracting the legs and transferring the seat from the intermediate position to a stored position in which the overall size of the seat is reduced (for example to facilitate storing of the seat).

Turning to FIG. 1, there is shown a supporting base structure 10 for a seat 100. Base structure 10 comprises three extendable and retractable legs 12. Each leg 12 includes an outer leg portion 13 and an inner leg portion 11 that may be translated relative to each other. Although not shown in FIG. 1, legs 12 are rotatably coupled to a pivot hub 20 described in further detail below. In particular, each leg 12 further includes a leg holder 40 to which is attached outer leg portion 13, and leg holders 40 are rotatably coupled to pivot hub 20. The upper ends of legs 12 are provided with leg caps 15. A seat cover 90, not shown in FIG. 1, may be secured to leg caps 15 using cap pins 16, as described in further detail below. The lower ends of legs 12 are provided with leg feet 17.

Figure 3:
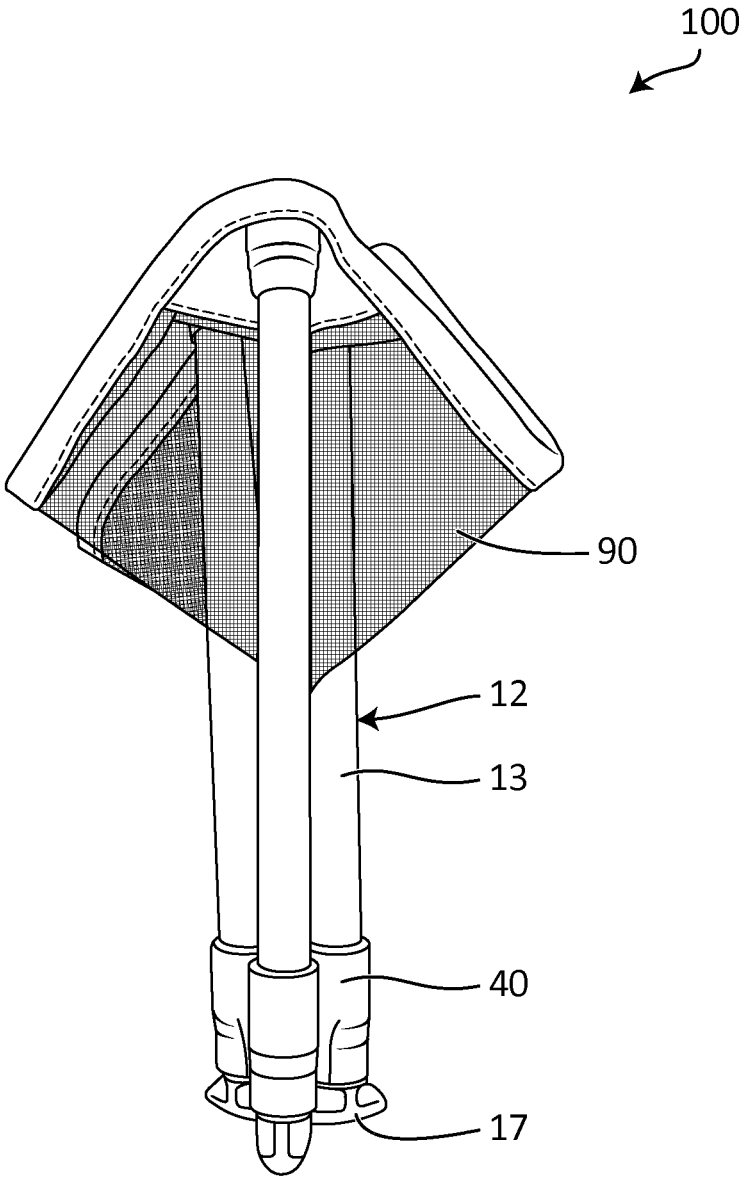
FIG. 3 shows a seat in a stored position with legs retracted, according to embodiments of the disclosure.

FIG. 1 depicts base structure 10 in an intermediate position, meaning that legs 12 are substantially in alignment or parallel to one another, and meaning that legs 12 are in their extended positions, i.e. inner leg portions 11 are extended out of outer leg portions 13. When inner leg portions 11 are retracted within outer leg portions 13, and legs 12 are in alignment, base structure 10 is said to be in a stored position. Such a stored position is shown in FIG. 3, which also shows seat 100 comprising seat cover 90 attached to legs 12.

Although legs 12 have been described and are shown as each having a single outer leg portion 13 and a single inner leg portion 11, legs 12 may comprise more than two leg portions, such as three leg portions arranged to telescope or otherwise translate relative to one another.

Figure 2:
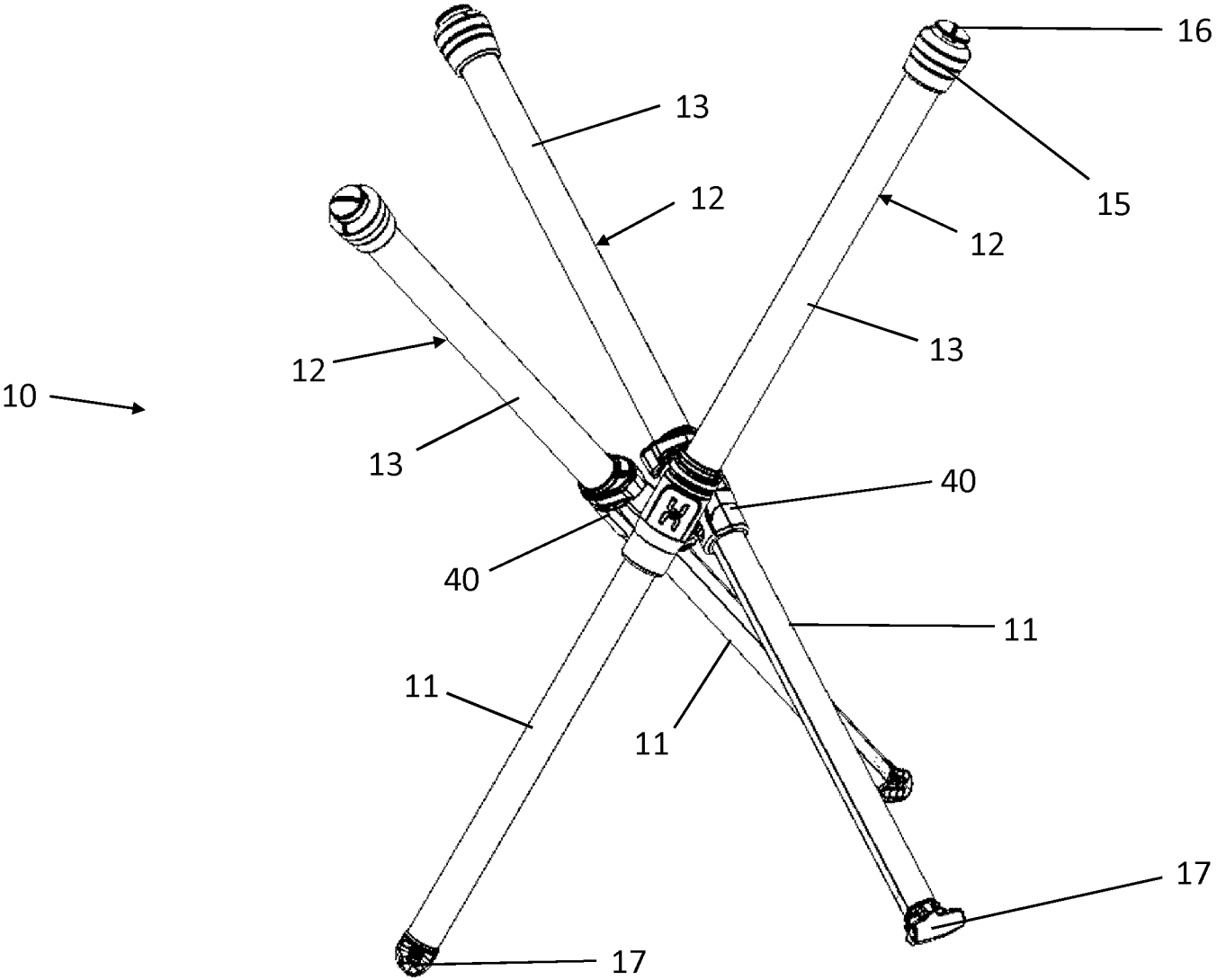
FIG. 2 shows the base structure of FIG. 1 in a deployed position with legs extended, according to embodiments of the disclosure.

FIG. 2 shows base structure 10 in a deployed position. To reach the deployed position starting from the intermediate position of FIG. 1, legs 12 are rotated relative to pivot hub 20 to bring legs 12 out of alignment with one another and into the position shown in FIG. 2. Starting from the deployed position of FIG. 2, legs 12 may be rotated back to the intermediate position of FIG. 1. The deployed position may refer to any position of legs 12 such that legs 12 are out of alignment with one another and such that legs 12 have not been extended to such an extent that seat cover 90 may no longer be attached to the upper ends of legs 12, as described in further detail below.

Figure 4B:
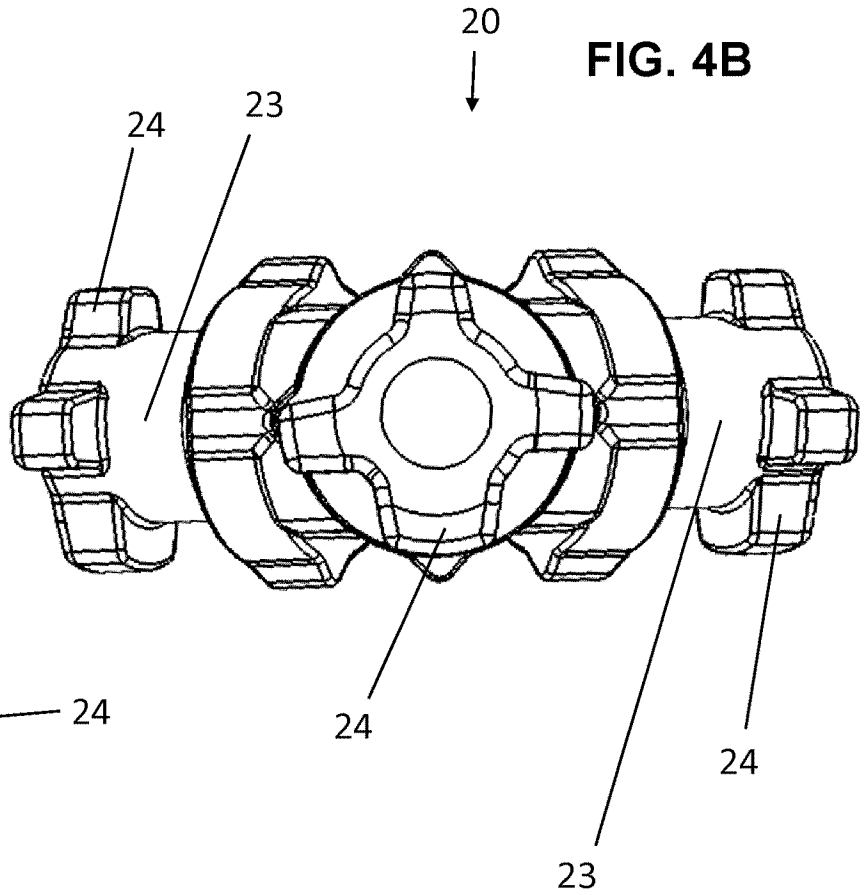
FIGS. 4A and 4B show a pivot hub according to embodiments of the disclosure.
Figure 4A:
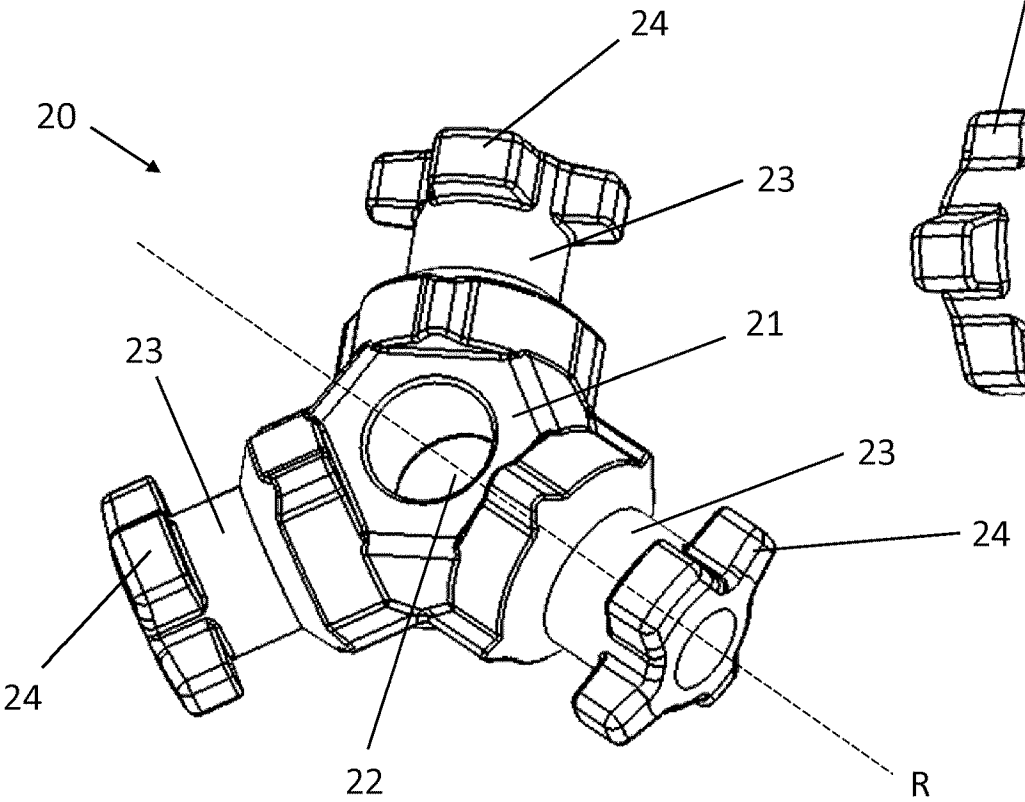

Turning to FIGS. 4A and 4B, there is shown pivot hub 20 in more detail. Pivot hub 20 comprises a central portion 21 from which extend multiple arms 23. An aperture 22 extends through central portion 21 in a direction perpendicular to the direction of extension of arms 23. Arms 23 define respective axes of rotation R (one of which is shown in FIG. 4A). The ends of arms 23 comprise a number of first alignment features or teeth 24. Teeth 24 can be seen in more detail in FIGS. 17A-17C. Teeth 24 extend in directions roughly perpendicular to the axes of rotation R defined by arms 23. Pivot hub 20 is shown to have three arms 23; however, in other embodiments, depending on the number of legs 12 that form seat 100, more or fewer arms 23 may be provided.

Figure 5B:
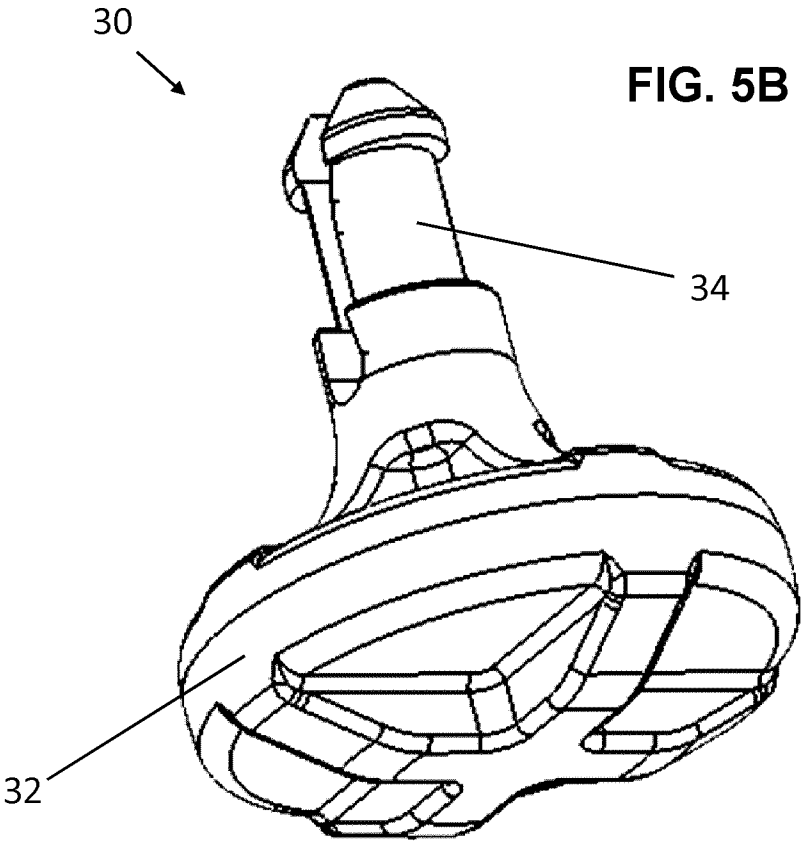
FIGS. 5A and 5B show a displacing module according to embodiments of the disclosure.
Figure 5A:
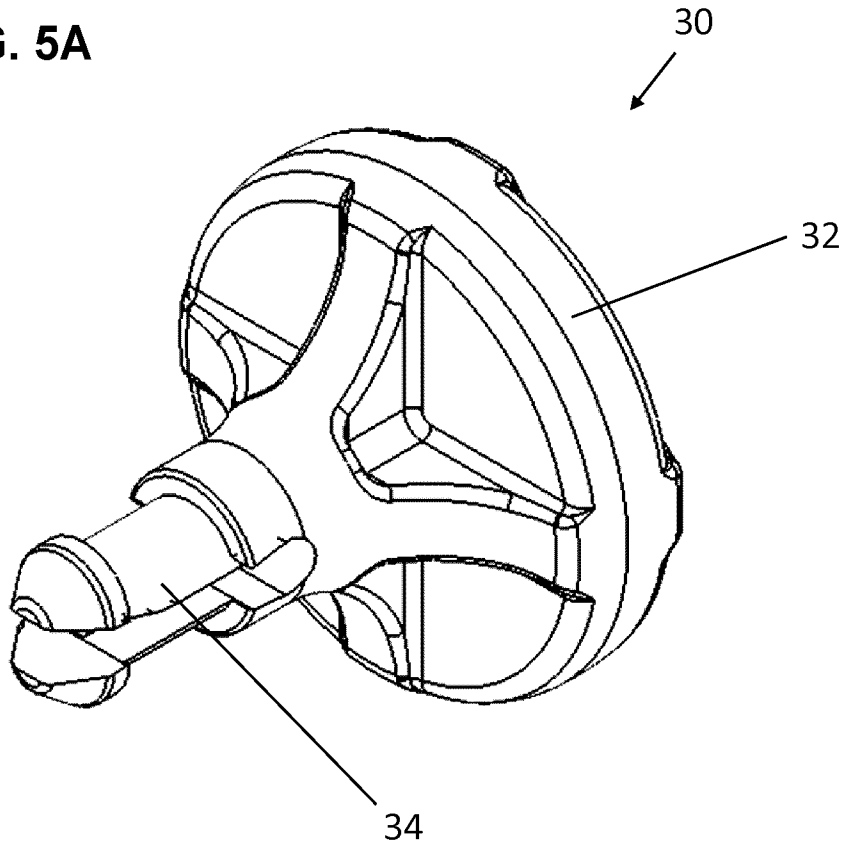
Figure 6:
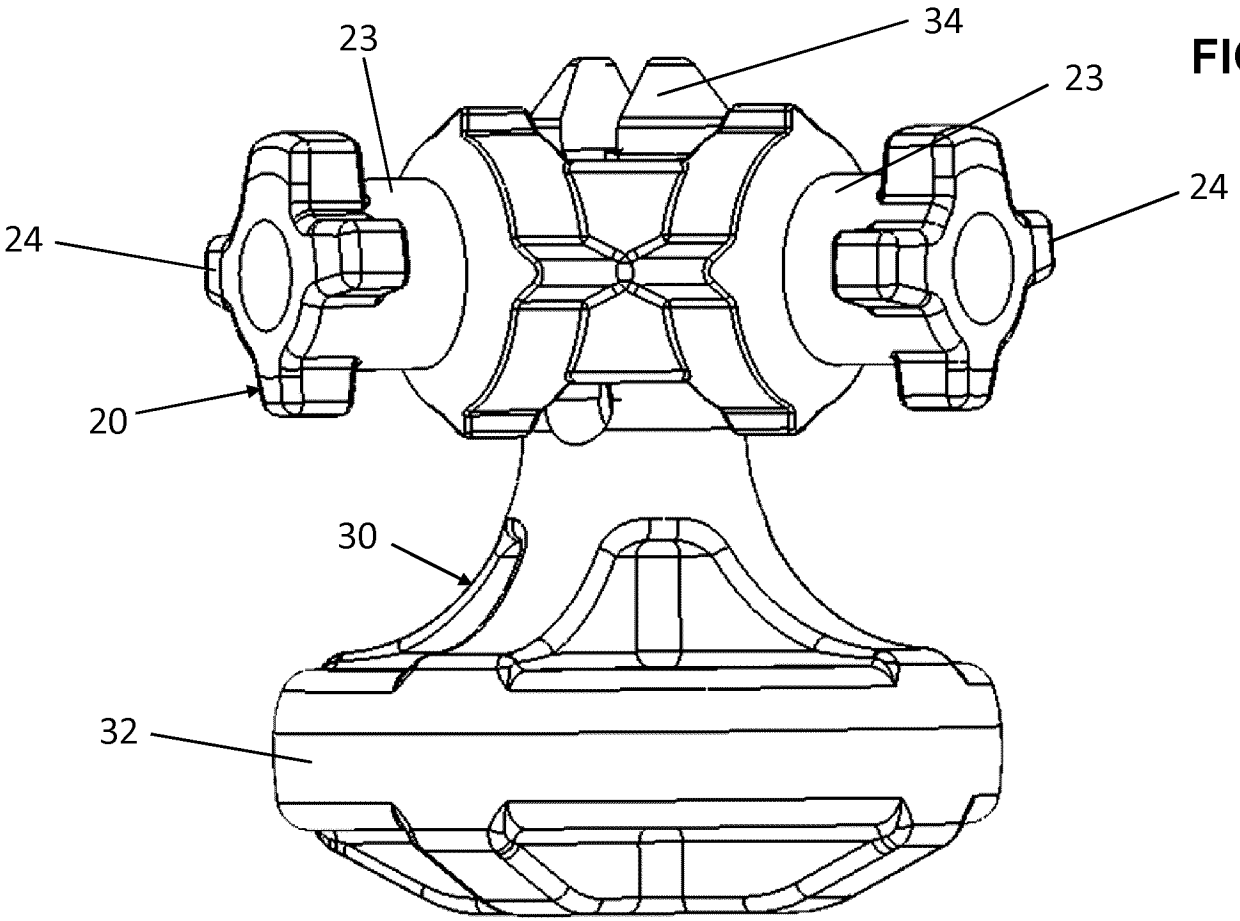
FIG. 6 shows the displacing module of FIGS. 5A and 5B connected to the pivot hub of FIGS. 4A and 4B, according to embodiments of the disclosure.

FIGS. 5A and 5B show a displacing module 30. Displacing module 30 comprises a generally circular displacing portion 32 and a connector 34 located centrally relative to displacing portion 32 and extending away from displacing portion 32. Connector 32 is configured to be inserted within aperture 22 of pivot hub 20 and fixedly couple displacing module 30 to pivot hub 20. FIG. 6 shows displacing module 30 coupled or otherwise connected to pivot hub 20, and extending downwardly from pivot hub 20.

Figure 7:
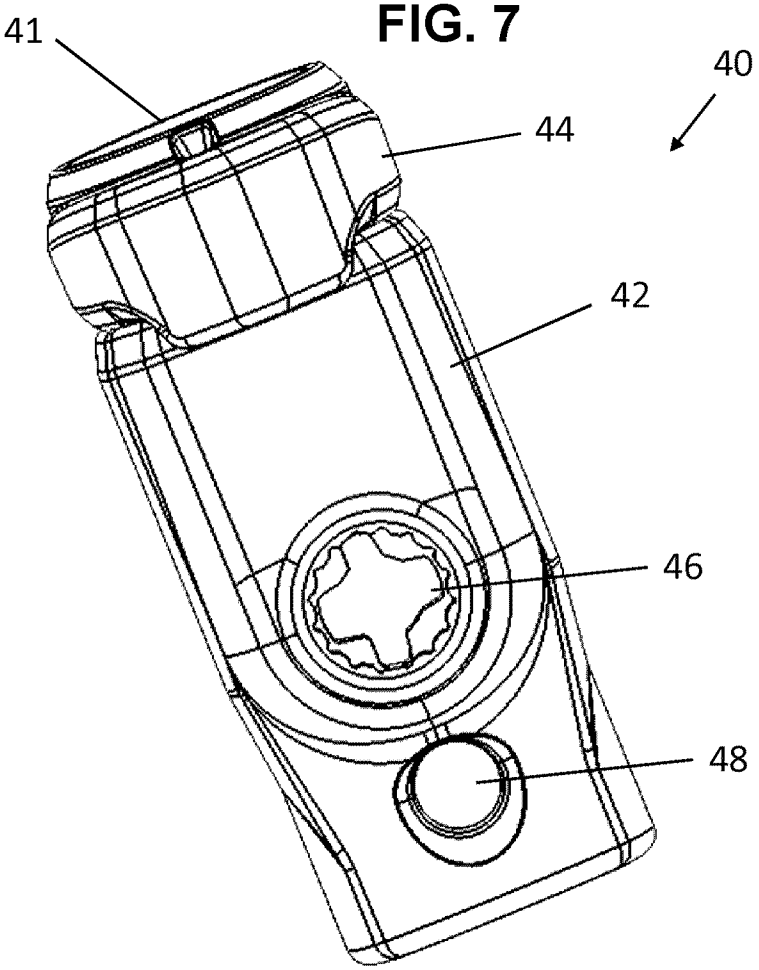
FIG. 7 shows a leg holder according to embodiments of the disclosure.

Turning to FIG. 7, there is shown one of leg holders 40 in more detail. Leg holder 40 is generally cylindrical in shape and includes a body portion 42 attached to a collar 44. Body portion 42 includes second alignment features or a grooved aperture 46 formed therein. Adjacent grooved aperture 46 is located a locking hole 48 formed within body portion 42. A central bore 41 extends through both collar 44 and body portion 42. Central bore 41 is shaped to receive the outer leg portion 13 and the inner leg portion 11 of one of legs 12.

Figure 8:
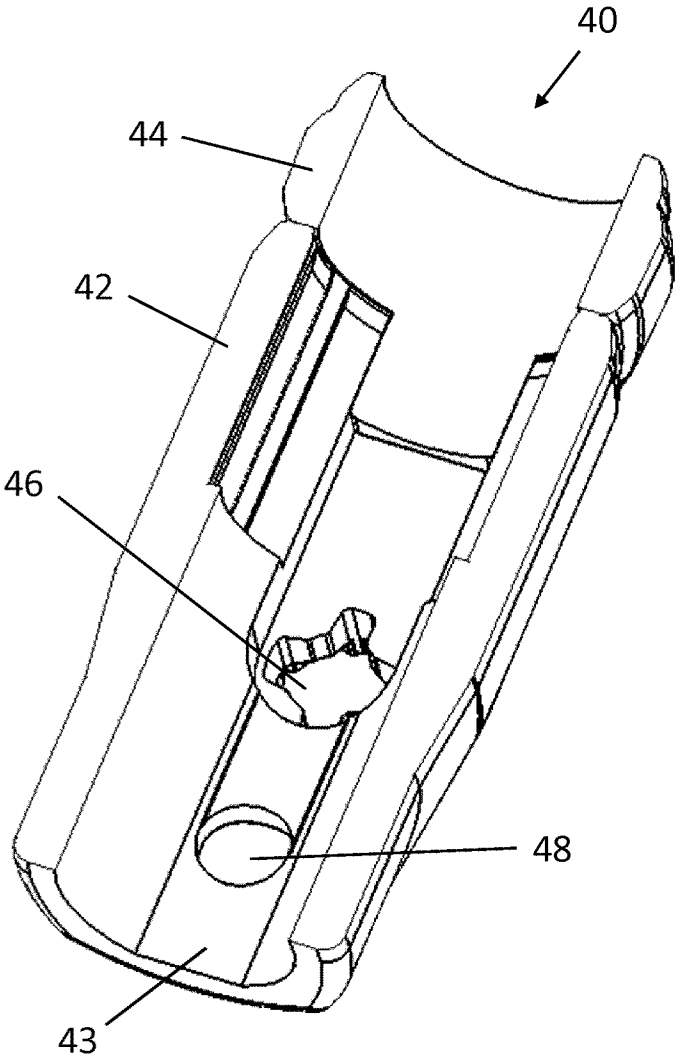
FIG. 8 shows a cross-section of the leg holder of FIG. 7, according to embodiments of the disclosure.

FIG. 8 shows a cross-section of leg holder 40. The inner sidewalls of bore 41 are generally circular in shape. A portion 43 of the inner sidewalls of central bore 41 is flat and comprises locking hole 48 formed therein.

Figure 9:
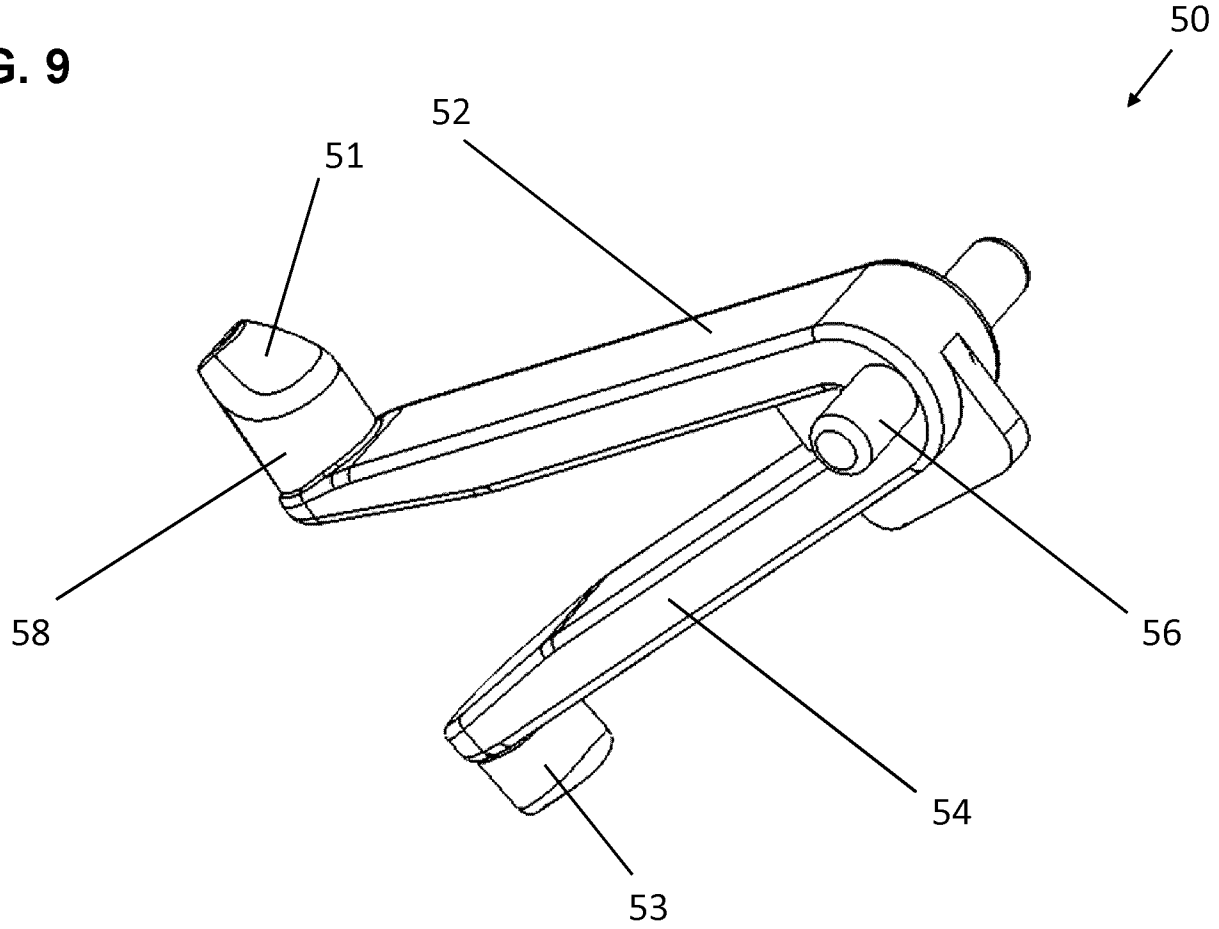
FIG. 9 shows a spring according to embodiments of the disclosure.

Turning to FIG. 9, there is shown a locking device or spring 50 that is used to lock one of legs 12 in its extended position. Spring 50 comprises a first elongate spring member 52 pivotally connected about a pivot 56 to a second elongate spring member 54. Second spring member 54 comprises a stop 53 at an end of second spring member 54 that is opposite pivot 56. First spring member 52 comprises a spring foot 58 at an end of first spring member 52 that is opposite pivot 56. Spring foot 58 includes a tapered portion 51 for facilitating retraction of spring foot 58 within the inner leg portion 11, as described in further detail below.

Figure 10:
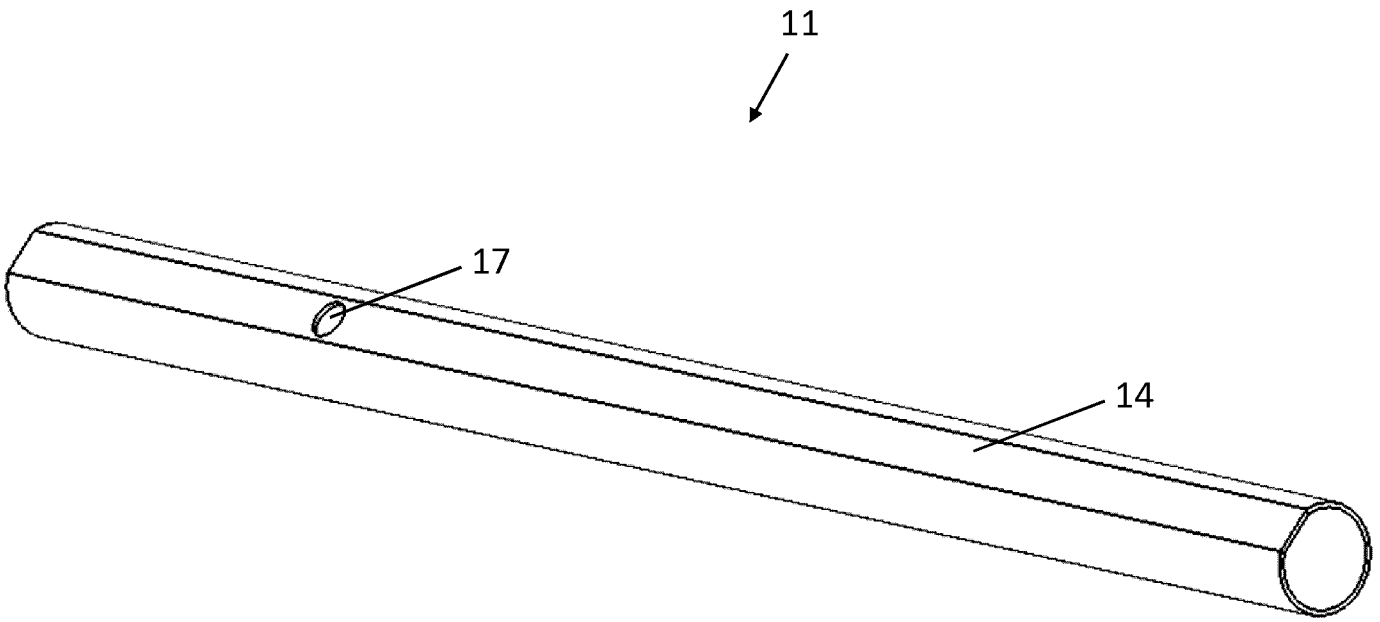
FIG. 10 shows an inner leg portion of a leg of the base structure of FIG. 1, according to embodiments of the disclosure.

FIG. 10 shows one of inner leg portions 11 in more detail. Inner leg portion 11 is generally tubular in shape except for a flat portion 14 extending along a length of inner leg portion 11. Within flat portion 14 is formed a locking hole 17. Locking hole 17 is located closer to a first end of inner leg portion 11 than a second end of inner leg portion 11.

Figure 11:
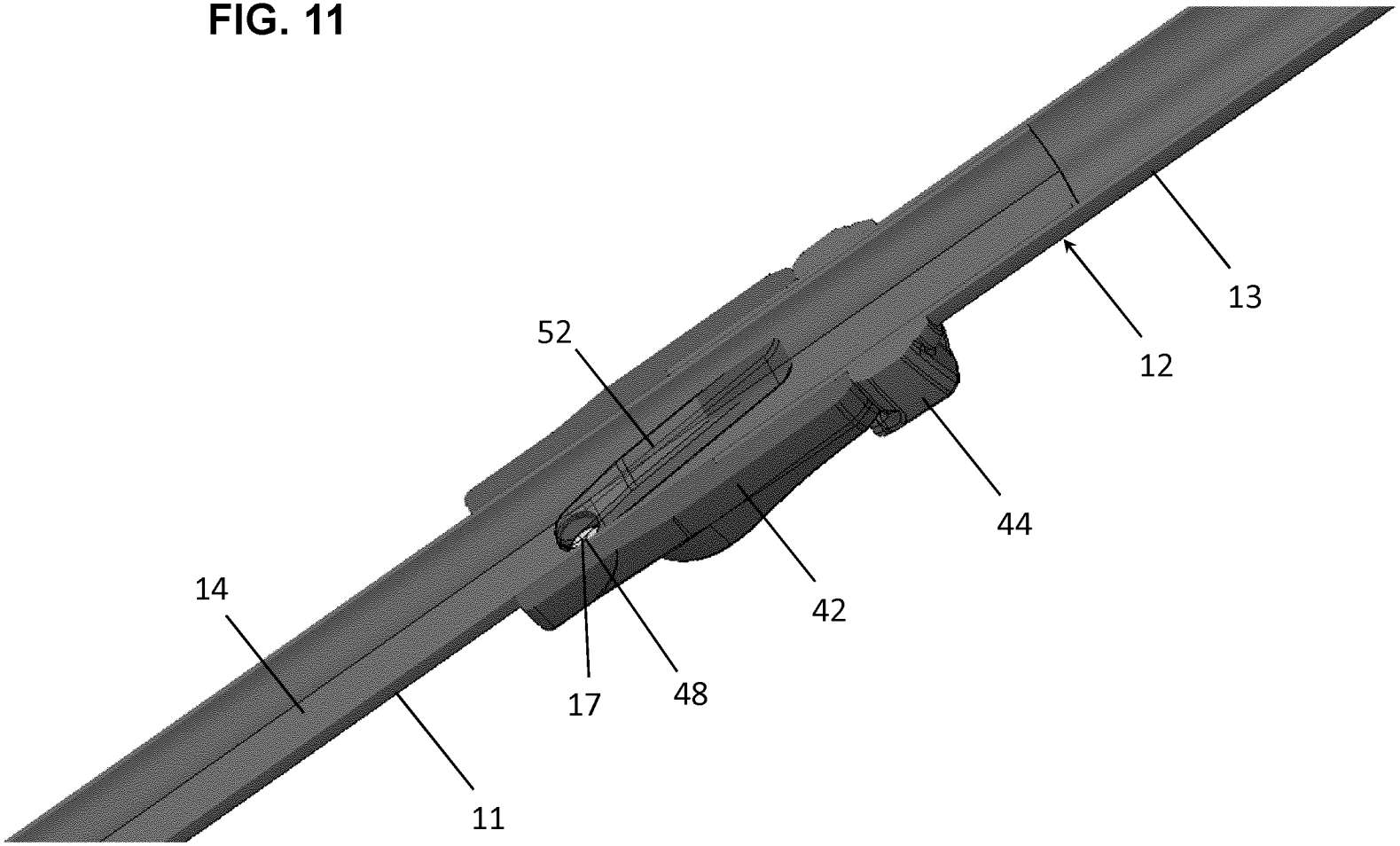
FIG. 11 shows the interconnection of the inner leg portion of FIG. 10, an outer leg portion, the leg holder of FIG. 7, and the spring of FIG. 9, according to embodiments of the disclosure.

FIG. 11 shows the interconnection of spring 50, inner leg portion 11, outer leg portion 13, and leg holder 40, in the extended position of leg 12. In particular, inner leg portion 11 is located partially within leg holder 40 such that flat portion 14 of inner leg portion 11 is aligned with flat portion 43 of leg holder 40. Furthermore, locking hole 17 of inner leg portion 11 is aligned with locking hole 48 of leg holder 40. Outer leg portion 13 is also located partially within leg holder 40. Inner leg portion 11 is arranged to slideably translate relative to and within outer leg portion 13. Spring 50 is fixed to the interior of inner leg portion 11. First spring member 52 (shown partially transparent) of spring 50 is positioned such that spring foot 58 extends through locking hole 17 of inner leg portion 11 and locking hole 48 of leg holder 40. Thus, in such a position, spring foot 58 prevents inner leg portion 11 from translating relative to outer leg portion 13.

Figure 12:
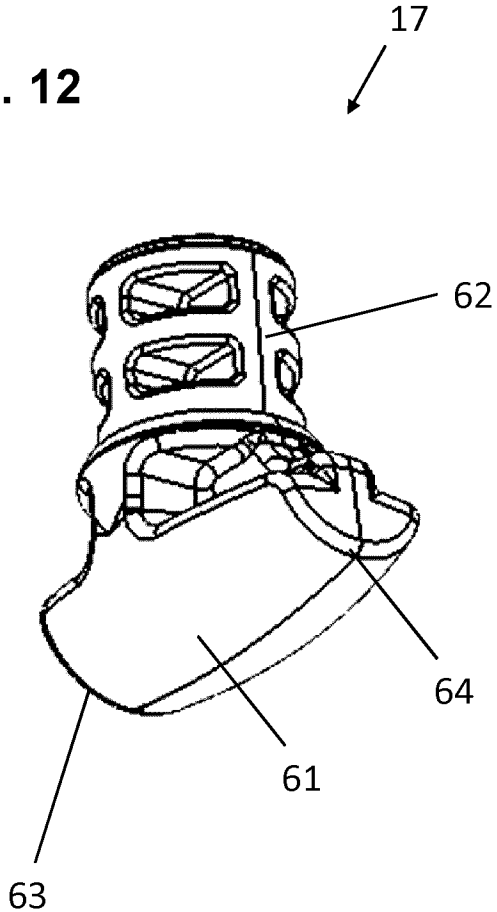
FIG. 12 shows a leg foot according to embodiments of the disclosure.

FIG. 12 shows one of leg feet 17 in more detail. Leg foot 17 comprises a curved base 61 and a connector 62 extending upwardly away from curved base 61, for attaching leg foot 17 to a lower end of inner leg portion 11. In particular, connecter 62 may be inserted within an open lower end of inner leg portion 11 in order to affix leg foot 17 to inner leg portion 11. Curved base 61 comprises a first portion 63 and relatively longer second portion 64, wherein a point at which connector 62 meets with curved base 61 divides curved base 61 into first portion 63 and relatively longer second portion 64.

Figure 13:
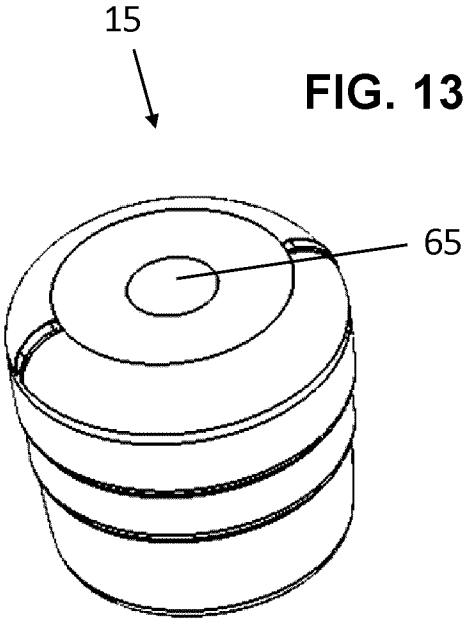
FIG. 13 shows a leg cap according to embodiments of the disclosure.

FIG. 13 shows one of leg caps 15 in more detail. Leg cap 15 may be located over an open upper end of one of outer leg portions 13. Leg cap 15 includes an aperture 65 formed within an upper surface thereof.

Figure 14:
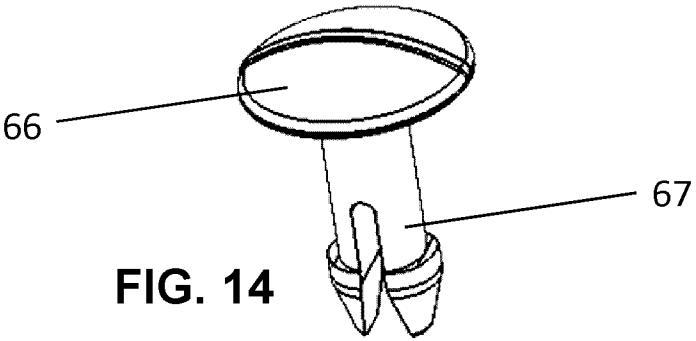
FIG. 14 shows a cap pin according to embodiments of the disclosure.

FIG. 14 shows one of cap pins 16 in more detail. Cap pin 16 comprises a connector 67 extending downwardly from a cap pin head 66.

Figure 16:
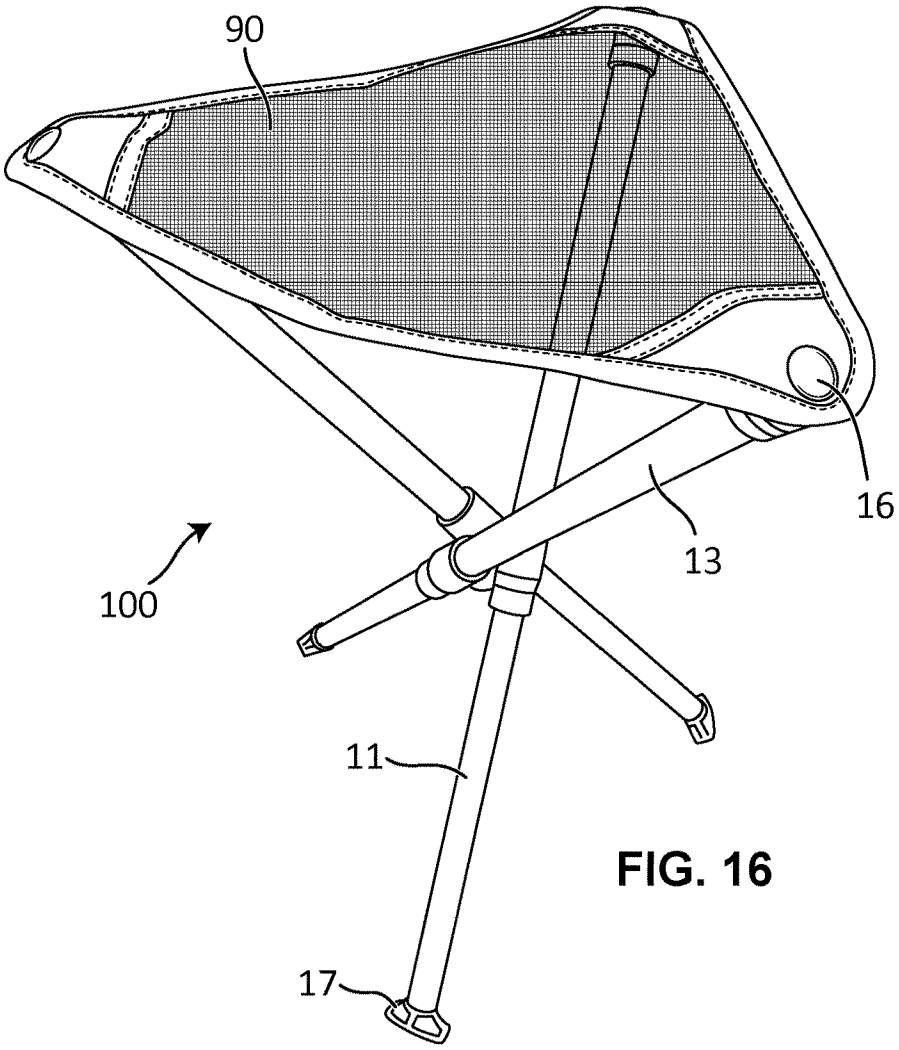
FIG. 16 shows a seat in the deployed position with legs extended, according to embodiments of the disclosure.
Figure 15:
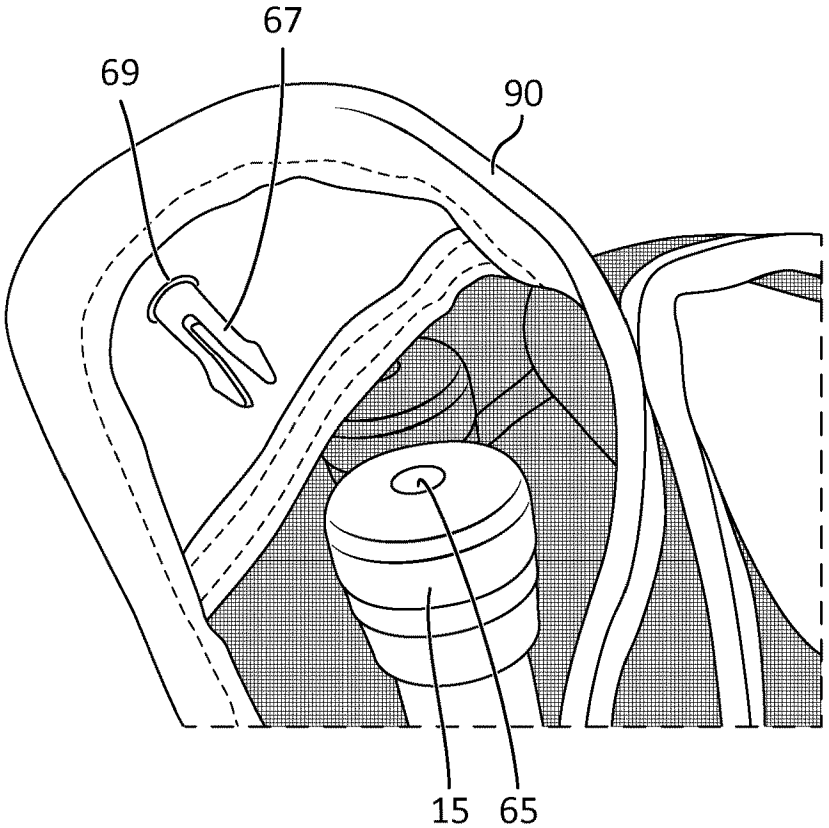
FIG. 15 shows a seat cover being attached to a leg, according to embodiments of the disclosure.

FIG. 15 shows a cap pin 16 with connector 67 inserted through an aperture 69 of seat cover 90. Connector 67 may then be removably inserted into aperture 65 of leg cap 15. FIG. 16 shows seat 100 in the deployed position, with legs 12 extended and cover 90 attached to legs 12 using cap pins 16. Cap pins 16 may be removed from leg caps 15 in order to release seat cover 90 from legs 12, or for example to replace a broken cap pin 16.

In accordance with embodiments of the disclosure, the assembly and deployment of seat 100 and base structure 10 will now be described in more detail.

A user first couples legs 12 (comprising outer leg portions 13, inner leg portions 11, and leg holders 40) to pivot hub 20 in the following fashion. In order to do so, grooved aperture 46 of one of leg holders 40 is aligned with corresponding teeth 24 of one of arms 23 of pivot hub 20. Teeth 24 are shaped to have complementary shapes to those of the grooves in grooved aperture 46. Once grooved aperture 46 is aligned with teeth 24, leg 12 is translated toward pivot hub 20. By moving leg 12 sufficiently toward pivot hub 20, teeth 24 are moved through grooved aperture 46 to within central bore 41 of leg holder 40. In this position, teeth 24 are disengaged from grooved aperture 46, thereby enabling leg 12 to be rotated relative to pivot hub 20. The respective shapes of teeth 24 and the grooves in grooved aperture 46 are such that teeth 24 align with grooved aperture 46 once every full rotation of leg 12 relative to pivot hub 20. This process is repeated for each other leg 12.

Figure 17B:
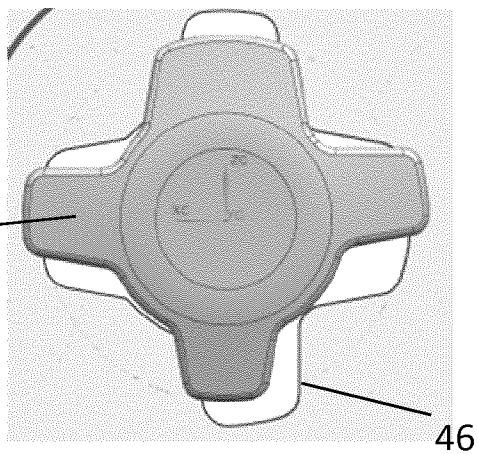
Figure 17C:
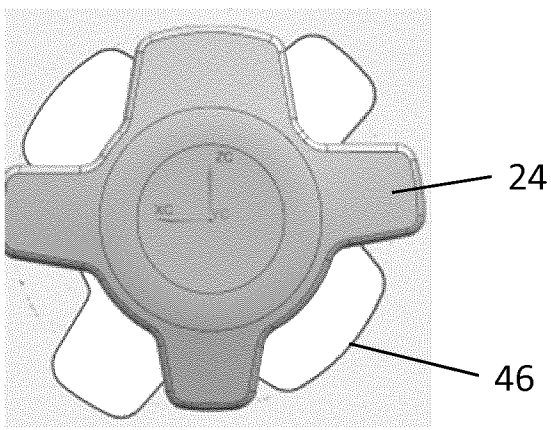
Figure 17A:
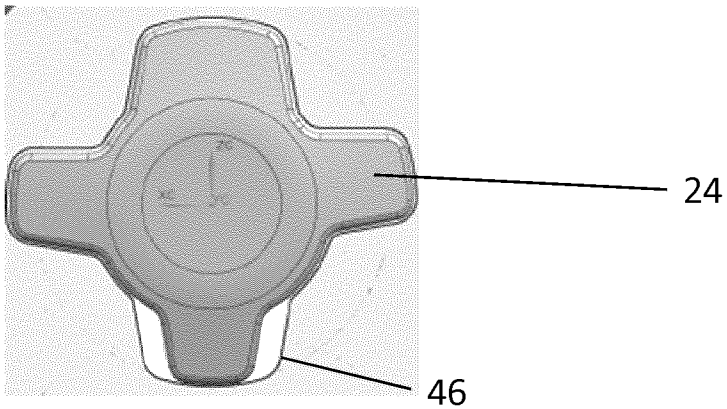

FIGS. 17A-17C illustrate different orientations of teeth 24 and grooved aperture 46, according to some embodiments of the disclosure. FIG. 17A shows teeth 24 aligned with grooved aperture 46, and FIGS. 17B and 17C show teeth 24 misaligned with grooved aperture 46. In order to prevent accidental decoupling of legs 12 from pivot hub 20, the orientation at which teeth 24 are aligned with grooved aperture 46 is not comprised in any orientations of legs 12 relative pivot hub 20 between the deployed position (FIG. 2) and the intermediate position (FIG. 1). For example, the orientation at which teeth 24 are aligned with grooved aperture 46 could correspond to the orientation of legs 12 in FIG. 1, except with the direction legs 12 reversed such that lower ends of legs 12 point upwardly and upper ends of legs 12 point downwardly.

Seat cover 90 is then attached to upper ends of legs 12 using leg caps 15 and cap pins 16, as described above. Once seat cover 90 is attached to legs 12, legs 12 are prevented from rotating beyond the position shown in FIG. 16, by virtue of seat cover 90 preventing further rotation of legs away from the intermediate position.

Figure 18B:
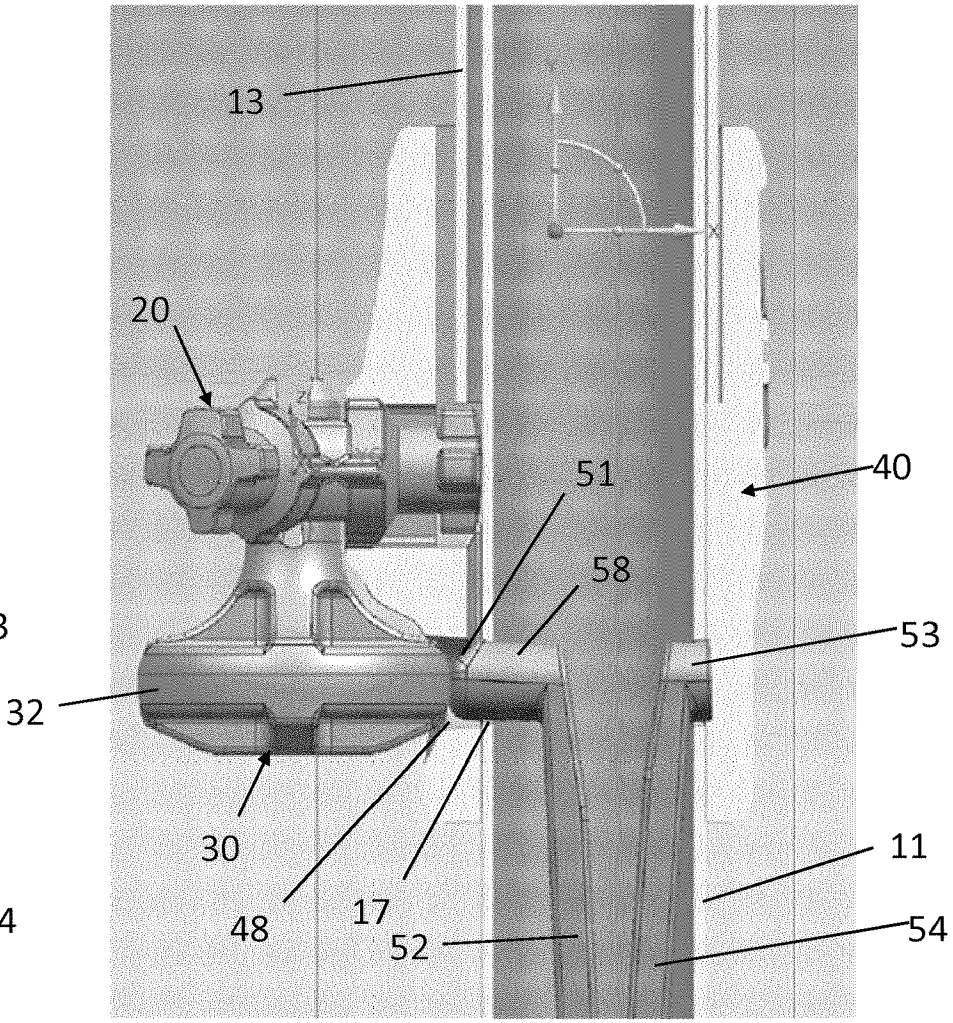
FIG. 18B shows a displacing module biasing the spring foot of FIG. 18A into an inner leg portion, when in the intermediate position, according to embodiments of the disclosure.
Figure 18A:
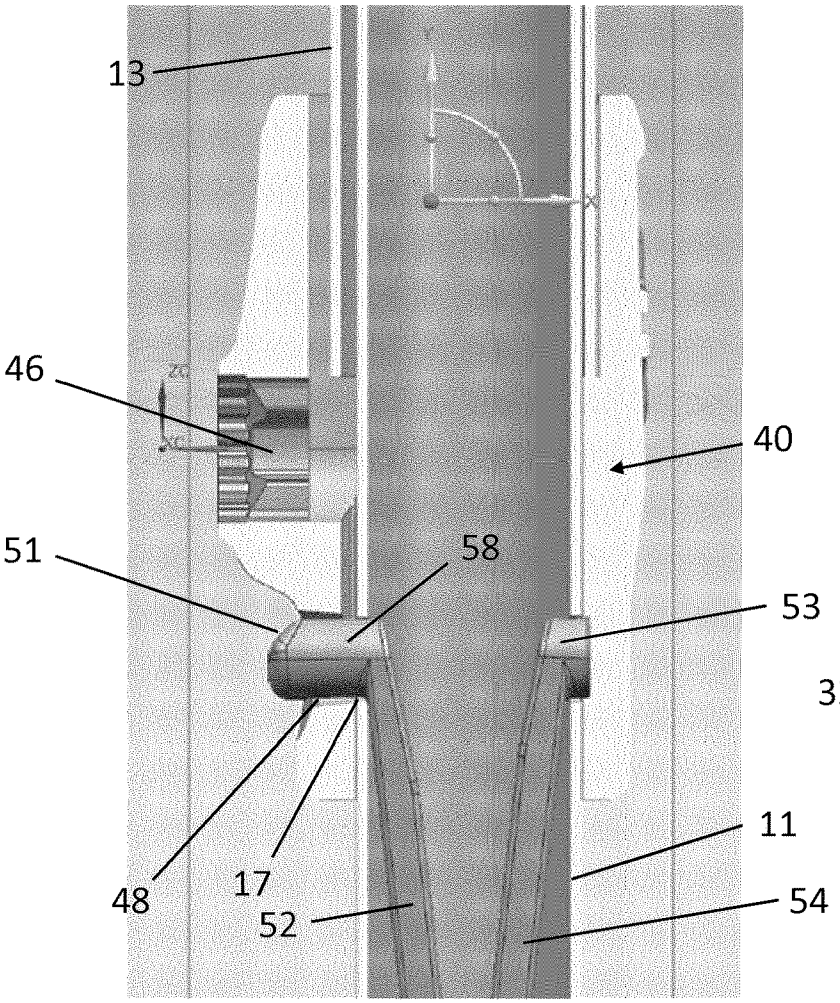
FIG. 18A shows a spring foot extending out of a leg holder, according to embodiments of the disclosure.

Irrespective of the particular orientation of legs 12 relative to pivot hub 20, legs 12 may be moved between their retracted states and their extended states. For example, in order to extend legs 12, a user may withdraw inner leg portions 11 from their respective outer leg portions 13. For example, a user may pull on a leg foot 17 and withdraw the corresponding inner leg portion 11 from its respective outer leg portion 13. During extension of the leg 12, flat portion 14 of inner leg portion 11 and flat portion 43 of leg holder 40 prevent relative rotation between inner leg portion 11 and leg holder 40. Therefore, given sufficient withdrawal of inner leg portion 11 from outer leg portion 13, locking hole 17 of inner leg portion 11 will come into alignment with locking hole 48 of leg holder 40. When locking hole 17 of inner leg portion 11 comes into alignment with locking hole 48 of leg holder 40, spring foot 58, biased by spring 50, is urged through locking hole 17 and locking hole 48 such that spring foot 58 extends through locking hole 17 and locking hole 48, as can be seen in FIG. 18A. With spring foot 58 extending through locking hole 17 and locking hole 48, inner leg portion 11 is prevented from further translating relative to outer leg portion 13. Thus, leg 12 is locked in the extended position.

When a user wishes to retract legs 12 (for example to collapse seat 100 for storage), extended legs 12 are rotated from the deployed position (FIG. 2) to the intermediate position (FIG. 1). In the intermediate position, legs 12 are aligned with one another. By bringing legs 12 into alignment with each other, displacing portion 32 of displacing module 30 is brought into contact with spring feet 58 and urges spring feet 58 back into their respective inner leg portions 11. In particular, as can be seen in FIG. 18B, displacing portion 32 has caused spring foot 58 to be urged or otherwise moved substantially back within inner leg portion 11. Although spring foot 58 is not fully retracted within inner leg portion 11, tapered portion 51 of spring foot 58 facilitates a user in urging spring foot 58 within inner leg portion 11. Once spring foot 58 is pushed fully back within inner leg portion 11, a user may retract leg 12 by pushing inner leg portion 11 back within outer leg portion 13, thereby bringing seat 100 to the stored position (FIG. 3).

Legs 12 may be extended/retracted in either or both of the intermediate position and the deployed position. For example, when legs 12 are initially aligned as shown in FIG.

3, legs 12 may then be partially or fully extended. Legs 12 may then be rotated to the deployed position, and finally legs 12 may be fully extended to thereby be locked in their extended positions (since, in the deployed position, displacing module 30 will not prevent spring feet 58 from locking legs 12 in their extended positions), bringing seat 100 to the position shown in FIG. 16.

Figure 19:
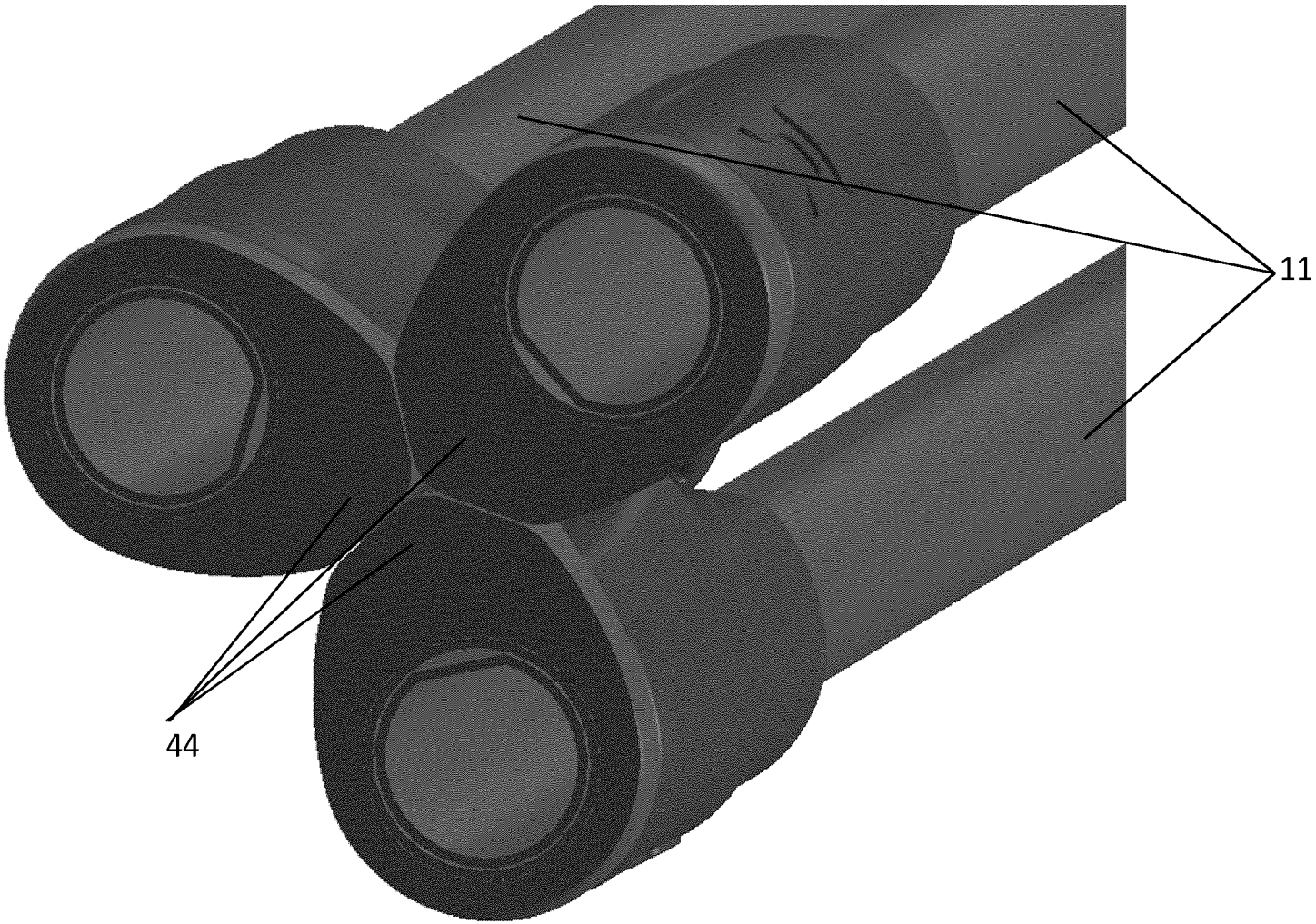
FIG. 19 shows a cross-section of the base structure of FIG. 1 in the intermediate position, according to embodiments of the disclosure.

As can be seen in FIG. 19, which shows a cross-section of collars 44 when legs 12 are in the intermediate position, collars 44 are configured to abut against each other in the intermediate position. Thus, when rotating legs 12 from the deployed position to the intermediate position, further rotation of the legs beyond the intermediate position is prevented by collars 44. Furthermore, collars 44 are sized such that moving collars 44 into engagement with each other brings spring feet 58 into the required position for displacement by displacing module 30.

While the disclosure has been described in connection with specific embodiments, it is to be understood that the disclosure is not limited to these embodiments, and that alterations, modifications, and variations of these embodiments may be carried out by the skilled person without departing from the scope of the disclosure.

For example, while the first and second alignment features have been described in the context of teeth and grooved apertures, the disclosure extends to any other suitable shape or configuration of features that, depending on their relative orientations to one another, may be brought into and out of alignment. For example, the first and second alignment features may comprise any suitably shaped male and/or female alignment features.

As a further example, while the displacing module has been described in the context of the device shown for example in FIGS. 5A and 5B, it is to be understood that any device or structure configured to cause the locking device of the legs to move from the locked to the unlocked position may be used.

It is also contemplated that any part of any aspect or embodiment discussed in this specification can be implemented or combined with any part of any other aspect or embodiment discussed in this specification.

The invention claimed is:

1. An assembly for a seat, comprising:

a pivot hub defining multiple rotation axes;

a displacing module for attaching to the pivot hub;

legs for rotatably coupling to the pivot hub, wherein at least one of the legs is extendable, the legs comprising one or more locking devices movable between an unlocked position, in which the at least one extendable leg, when extended, is enabled to retract, and a locked position, in which the at least one extendable leg, when extended, is prevented from retracting, wherein the legs, when rotatably coupled to the pivot hub, are rotatable about the rotation axes between an intermediate position and a deployed position, wherein, when the least one extendable leg is extended and when the displacing module is attached to the pivot hub:

in the intermediate position, the displacing module engages the one or more locking devices to move the one or more locking devices from the locked position to the unlocked position; and rotating the legs from the intermediate position to the deployed position brings the displacing module out of contact with the one or more locking devices.

2. The assembly of claim 1, wherein:

the pivot hub comprises first alignment features;

the legs further comprise second alignment features for aligning with the first alignment features;

when the first alignment features are aligned with the second alignment features, the legs are translatable relative to the pivot hub and along the rotation axes such that the legs may be coupled with the pivot hub; and when the legs are coupled with the pivot hub, and when the first alignment features are not aligned with the second alignment features, the legs are prevented from being decoupled from the pivot hub by engagement of the first alignment features with the second alignment features.

3. The assembly of claim 2, wherein the first and second alignment features are shaped such that the first alignment features align with the second alignment features once every full rotation of the legs relative to the pivot hub.

4. The assembly of claim 2, wherein the first alignment features and the second alignment features do not align with one another during rotation of the legs relative to the pivot hub from the intermediate position to the deployed position, wherein in the deployed position the legs have been rotated to an extent required for apertures in a seat cover to be aligned with apertures formed within upper ends of the legs.

5. The assembly of claim 1, wherein the pivot hub further comprises arms extending from a central portion of the pivot hub, wherein the arms define respective ones of the rotation axes.

6. The assembly of claim 1, wherein the at least one extendable leg comprises:

at least one inner leg portion arranged to translate relative to at least one outer leg portion; and a leg holder comprising one or more of the second alignment features and fixed to the at least one inner leg portion or the at least one outer leg portion.

7. The assembly of claim 6, wherein the leg holder is fixed to the at least one outer leg portion.

8. The assembly of claim 6, wherein the leg holder comprises a first aperture formed therein, wherein the at least one inner leg portion and/or the at least one outer leg portion comprises a second aperture formed therein, and wherein the first and second apertures are positioned such that translating the at least one inner leg portion relative to the at least one outer leg portion causes the first and second apertures to be brought into alignment.

9. The assembly of claim 6, wherein the at least one extendable leg comprises one or more portions thereof for preventing rotation of the at least one inner leg portion or the at least one outer leg portion relative to the leg holder.

10. The assembly of claim 1, wherein the one or more locking devices comprise one or more resilient biasing members.

11. The assembly of claim 10, wherein the one or more resilient biasing members comprise one or more springs with one or more spring feet, wherein the one or more springs are arranged to bias the one or more spring feet such that, in the locked position and when the at least one extendable leg is in the deployed position, the one or more spring feet extend through one or more leg apertures formed in the at least one extendable leg.

12. The assembly of claim 11, wherein the one or more springs are further arranged to bias the one or more spring feet such that, in the locked position and when the at least one extendable leg is in the deployed position, the one or more spring feet further extend through one or more leg holder apertures formed in a leg holder fixed to the at least one extendable leg.

13. The assembly of claim 11, wherein the one or more leg apertures are formed in at least one inner leg portion of the at least one extendable leg, the at least one inner leg portion being arranged to translate relative to at least one outer leg portion of the at least one extendable leg.

14. The assembly of claim 11, wherein, when the at least one extendable leg is extended and is in the intermediate position, and when the displacing module is attached to the pivot hub, the displacing module is shaped to engage the one or more spring feet and prevent the one or more spring feet from extending through the one or more leg apertures, thereby enabling retraction of the at least one extendable leg.

15. The assembly of claim 11, wherein the one or more spring feet further comprise one or more tapered portions, wherein, when the at least one extendable leg is extended and is in the intermediate position, and when the displacing module is attached to the pivot hub, the displacing module is shaped to engage the one or more spring feet and prevent the one or more spring feet from extending out of the one or more leg holder apertures, and wherein the one or more tapered portions facilitate retraction of the at least one extendable leg.

16. The assembly of claim 1, further comprising a seat cover for attaching to upper ends of the legs.

17. The assembly of claim 1, wherein the legs comprise feet at lower ends thereof, and wherein the feet comprise first feet members and second feet members that are longer than the first feet members, and wherein the legs meet the feet where the first portions meet the second portions.

18. An assembly for a seat, comprising:

a pivot hub defining multiple rotation axes;

a displacing module attached to the pivot hub;

legs rotatably coupled to the pivot hub, wherein at least one of the legs is extendable, the legs comprising one or more locking devices movable between an unlocked position, in which the at least one extendable leg, when extended, is enabled to retract, and a locked position, in which the at least one extendable leg, when extended, is prevented from retracting, wherein the legs are rotatable about the rotation axes between an intermediate position and a deployed position, wherein, when the least one extendable leg is extended:

in the intermediate position, the displacing module engages the one or more locking devices to move the one or more locking devices from the locked position to the unlocked position; and rotating the legs from the intermediate position to the deployed position brings the displacing module out of contact with the one or more locking devices.

19. The assembly of claim 6, wherein the leg holders are sized such that, when rotating the legs in a direction of rotation from the deployed position to the intermediate position, at the intermediate position the leg holders engage with one another and prevent further rotation of the legs in the direction of rotation.

* * * * *